US007610961B2

(12) United States Patent
Manin et al.

(10) Patent No.: US 7,610,961 B2
(45) Date of Patent: Nov. 3, 2009

(54) DOWNHOLE SEPARATION OF OIL AND WATER

(75) Inventors: Yves Manin, Le Plessis Robinson (FR); Fadhel Rezgui, Sceaux (FR); Bernard Theron, Bergen (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 43 days.

(21) Appl. No.: 10/537,957

(22) PCT Filed: Nov. 26, 2003

(86) PCT No.: PCT/EP03/13305

§ 371 (c)(1),
(2), (4) Date: Jan. 27, 2006

(87) PCT Pub. No.: WO2004/053291

PCT Pub. Date: Jun. 24, 2004

(65) Prior Publication Data

US 2006/0144589 A1 Jul. 6, 2006

(30) Foreign Application Priority Data

Dec. 12, 2002 (GB) ..... 0228968.4

(51) Int. Cl.
*E21B 43/28* (2006.01)

(52) U.S. Cl. ..... 166/265; 166/50; 166/263

(58) Field of Classification Search ..... 166/50, 166/265, 263

See application file for complete search history.

(56) References Cited

U.S. PATENT DOCUMENTS 4,766,957 A 8/1988 McIntyre (Continued)

FOREIGN PATENT DOCUMENTS

GB 2326895 1/1999

(Continued)

*Primary Examiner*—William P Neuder
*Assistant Examiner*—Nicole A Coy
(74) *Attorney, Agent, or Firm*—Myron Stout; Darla P. Fonseca; Jaime Castano

(57) ABSTRACT

A well for producing oil from an underground formation, comprises a vertical section extending from the surface to a depth below the oil-producing formation; a sidetrack or perforated interval (production zone) extending from the vertical section into the oil-producing formation; and a valve, located in the well, and operable to prevent flow of fluid from the vertical section into the production zone and a valve to prevent flow of fluid from the portion below the production zone into the production zone or into the vertical section above the production zone. A method of producing oil from the well comprises allowing oil and water to flow into the well via the production zone until the hydrostatic pressure of the oil and water in the well balances the formation pressure of the oil-producing formation such that further flow into the well ceases; allowing the oil and water in the vertical section of the well to separate under gravity so as to produce (i) a lower layer of water, at least part of which is located in the part of the vertical section below the oil-producing formation, and (ii) an upper layer of oil having its upper surface below the well surface and its lower surface above the production zone; forcing the separated oil and water back down the well and operating the valve such that substantially no fluid is forced into the production zone, an water is forced into the underground formation below the oil-producing formation; and allowing oil and water flow to recommence from the production zone.

8 Claims, 3 Drawing Sheets

U.S. PATENT DOCUMENTS 5,762,149 A * 6/1998 Donovan et al. ..... 175/40
5,873,410 A 2/1999 Iato et al.
6,196,313 B1 3/2001 Simons
6,213,208 B1 4/2001 Skilbeck
6,279,651 B1 8/2001 Schwendemann et al.
6,325,152 B1 12/2001 Kelley et al.
6,336,503 B1 1/2002 Chachula et al.
6,719,048 B1 * 4/2004 Ramos et al. ..... 166/250.15
2001/0017207 A1 * 8/2001 Haheim ..... 166/265

FOREIGN PATENT DOCUMENTS

WO WO99/15755 A 4/1999

* cited by examiner

DOWNHOLE SEPARATION OF OIL AND WATER

The present invention relates to methods for constructing and operating oil wells, in particular to such methods which allow the downhole separation of oil and water produced from the formation, and artificial lift of these fluids to the surface.

Because of the manner in which oil is formed in underground formations, it is very common that, after an initial water-free production, when oil is produced from a well, a certain amount of water is also produced. When this occurs, it is necessary to separate the oil from the water, the water being disposed of, typically by re-injection into the earth formations. Separation of oil from water usually takes place at the surface and numerous devices are available for this purpose. These devices often operate using gravity or a cyclone principle. The exact nature of the separation device will depend on the ratio of oil and water, and the total volume of fluid produced. This ratio will usually change over the life of a well since water is usually less viscous than oil and so moves more easily through the formations and into the well. Typically, the more water there is produced from a well, the more complex, expensive and energy-consuming the surface separation equipment is. Also, a large power requirement will involve further expense installation of power supplies and of the ongoing power supply to operate the installation. This can be increased significantly when the well is in a remote or difficult to reach location.

WO 01/44620 describes an installation for producing dewatered oil from a well. U.S. Pat. No. 6,279,651 describes an installation for managing the production from complex wells having multiple sidetracks, involving the use of operable valves to control production.

Another problem that is encountered in the production of oil from wells is that of low formation pressure. In most cases, the pressure of fluid (gas, oil and water) in the formation is greater than the hydrostatic pressure of the fluid column in the well above the zone of the well from which the fluids are produced. Consequently, the fluids will flow naturally to the surface. However, in many cases the formation pressure is insufficient to flow the fluids all the way to the surface, often due to the presence of water leading to a high hydrostatic load. At some point, the flow of fluids into the well creates a fluid column that creates a hydrostatic pressure that exactly balances the formation pressure at the point of the well where the fluids enter. Therefore no further flow can take place and the well is said to have killed itself. The low formation pressure might be due to the natural state of the reservoir, the concentration of water in the produced fluids, or might be due to depletion of fluids in the reservoir following long periods of production. In either case, it is necessary to provide some form of assistance to flow the fluids to the surface. One such form is the use of pumps. A pump located at the surface can only produce a maximum theoretical pressure drop of 1 bar which is approximately the equivalent of 10 m vertical depth from which fluid can be raised. If the formation pressure is insufficient to bring the surface of the fluid column to within 10 m of the surface, it is necessary for the pump to be located at the bottom of the well. Such pumps are known as electric submersible pumps (ESP's) and are immersed in the well fluids and provided with electrical power from the surface via a cable running down the well. The power requirement of an ESP is typically in the order of hundreds of kW but significant power losses in the well means that the supply at the surface must be much larger than this. The pumps themselves are often long, in the order of 10-20 m, and currently have a reliability of only 6-12 months between failures. Following failure, the ESP must be removed from the well and repaired or replaced; an expensive and time consuming operation during which the well cannot produce and personnel and equipment must be brought to the well site, all of which incurs expense.

The two problems identified above often go hand-in-hand, low formation pressures accompanied by large amounts of water produced from the formation. Thus the cost of production is even higher, sine the pumps are used to pump a mixture of oil and water of only the oil has value but which must be separated to realise this value.

The present invention aims to provide techniques for well construction and operation that potentially address these problems.

The invention provides a well for producing oil from a well comprising: a vertical section extending from the surface to a depth below the oil-producing formation; a sidetrack extending from the vertical section into the oil-producing formation; and a first valve, located in the well, and operable to prevent flow of fluid from the vertical section into the sidetrack; a second valve, located in the well, and operable to prevent flow fluid from the portion of the vertical section below the oil-production formation into the sidetrack or the portion of the vertical section of the well above the sidetrack; said method comprising the step of: allowing oil and water to flow into the well via the sidetrack until the hydrostatic pressure of the oil and water in the well balances the formation pressure of the oil-producing formation such that further flow into the well ceases; allowing the oil and water in the vertical section of the well to separate under gravity so as to produce (i) a lower layer of water, at least part of which is located in the part of the vertical section below the oil-producing formation, and (ii) an upper layer of oil having its upper surface below the well surface and its lower surface above the sidetrack; forcing the separated oil and water back down the well and operating the first valve such that substantially no fluid is forced into the sidetrack, and water is forced into the underground formation below the oil-producing formation; and allowing oil and water flow to recommence from the sidetrack.

The vertical section of the well preferably extends into a water-containing formation immediately below the oil-producing layer. While the term "vertical" is used here, it will be appreciated that it is not essential that the section be truly vertical, deviations from vertical typical in normal, non-directional, drilling being permissible. The important feature is that the vertical section extends from the surface to below the oil-producing formation.

The sidetrack will typically be much more deviated from vertical than the vertical section and may include a section that is horizontal or close thereto. Again, the well trajectory and deviation will be in line with what is normally considered acceptable in "horizontal" wells that extend laterally through producing reservoirs. A conventional perforated interval can be used to allow produced fluids to enter the well.

By providing the vertical section which extends away from the oil-producing formation, it is possible to use the vertical section of the well as a separator while avoiding filling the sidetrack with water and interfering with future oil production.

Preferably, separated oil and water is forced down the well until the oil water interface is close to the lower end of the second zone. The steps of flowing, separating, forcing back are typically repeated until oil flows from the well at the surface. The step of forcing separated oil and water down the well can be performed by applying pressure to the second zone from the surface, for example by pumping a lighter fluid such as oil or gas into the second zone.

Where the well is defined by its manner of completion, the method can comprise producing the oil and water into the casing or production tubing, allowing the water and oil to separate therein and forcing the separated fluids back down the casing or tubing such that water is forced into the production tubing defining the third zone so as to be produced at the surface.

Where the well is defined by its manner of construction, the method can comprise allowing oil and water to flow into the well via the sidetrack until the hydrostatic pressure of the oil and water in the well balances the formation pressure of the oil-producing formation such that further flow into the well ceases; allowing the oil and water in the vertical section of the well to separate under gravity so as to produce (i) a lower cushion of water, at least part of which is located in the part of the vertical section below the oil-producing formation, and (ii) an upper cushion of oil having its upper surface below the well surface and its lower surface above the sidetrack; forcing the separated oil and water back down the well and operating the valve such that substantially no fluid is forced into the sidetrack, and only water is forced into the underground formation below the oil-producing formation; and allowing oil and water flow to recommence from the sidetrack.

It is preferred that the separated oil and water are forced back down the well until the lower surface of the oil layer is close to or level with the sidetrack.

The steps of flowing, separating, forcing back are repeated until oil flows naturally from the well at the surface or until it can be pumped from the well.

By allowing the oil and water to separate and then producing the water at surface or re-injecting water into the formation below the oil-producing formation, the weight (explanation: the height is always the same, this is the sidetrack depth) of the fluid column in the well above the sidetrack is reduced and consequently the hydrostatic pressure in the producing formation in the first zone is reduced. This allows more fluid (oil+water) to flow from the oil-producing formation into the first zone Also, the fact that most of the fluid column is now oil means that the column has a density that is lower than the original mixture (oil being less dense than water) and so the hydrostatic pressure will be even lower than that cause merely by reducing the height of the liquid column before recommencing flowing. Thus, it will be possible to raise the top of the column closer to the surface and after some repetitions can allow either natural flow from the well, or easy pumping from the surface.

Also, by allowing the oil to separate in the well, the fluids produced at the surface will have little or no water content and so require less separation.

The time for which the oil and water mixture is allowed to separate may be the average time for a bubble of oil to rise from the middle of the mixed phases, to the middle of the separated oil phase. This time can be determined from the volume fractions of water and oil in the mixture and the bubble size of the oil. The volume fractions can be obtained from surface testing or production logging. The bubble size is typically a function of the volume fraction of oil and can be obtained either by direct measurement downhole using suitable production logging tools, or by use of a predetermined relationship established between oil volume fraction and bubble diameter. Typical separation times will be of the order of a few minutes.

The present invention will now be descried by way of examples, with reference to the accompanying drawings, in which.

Figure 1:
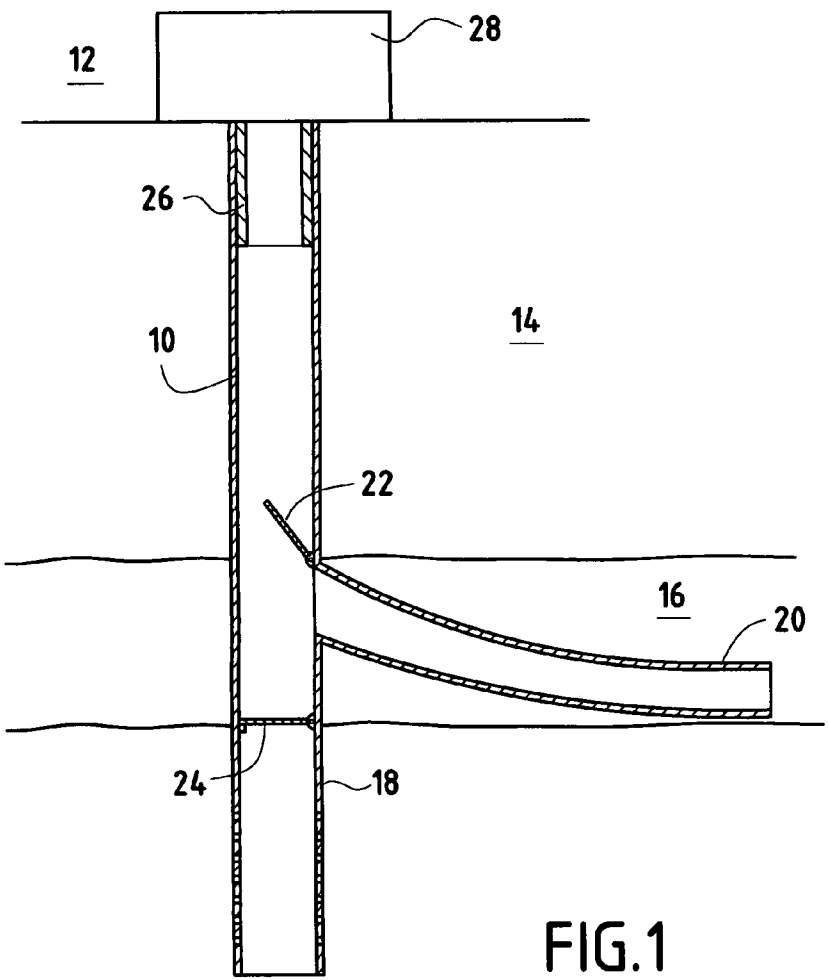
FIG. 1 shows a well in accordance with one aspect of the invention.

FIG. 1 shows a well according to one aspect of the invention. The well comprises a vertical section 10, which extends downwardly from the surface 12 (or if in an offshore environment, the sea bed) and passes through underground formations 14, including an oil-bearing formation 16 and terminates in a section 18 below the oil-bearing formation 16. As is common in this field, it is not essential that the well be completely vertical, normal degrees of deviation being acceptable. The well has a lateral production branch 20 extending from the vertical section 10 into the oil-bearing formation 16. As is common with such horizontal or lateral branches, the track of the branch 20 is not completely horizontal but angles downwardly away from the vertical section 10. This branch 20 can be completed in the normal manner for production, for example, with slotted liners or the like, or open-hole ("barefoot"). A valve 22 is located at the end of the lateral branch 20 and operates so as to prevent flow from the vertical section 10 into the lateral branch 20. A further valve 24 is located in the lower section 18 immediately below the lateral branch 22 and acts to prevent flow from the lower section 18 in to the upper part of the well. The top section of the well is completed with production tubing 26 in the normal manner. A production unit 28 is located at the surface to allow fluids to be removed from the well, possibly by pumping and to allow gas or other fluids to be injected into the upper part of the well. The surface unit will also include power supplies, separators, compressors and other such surface equipment.

Figure 2:
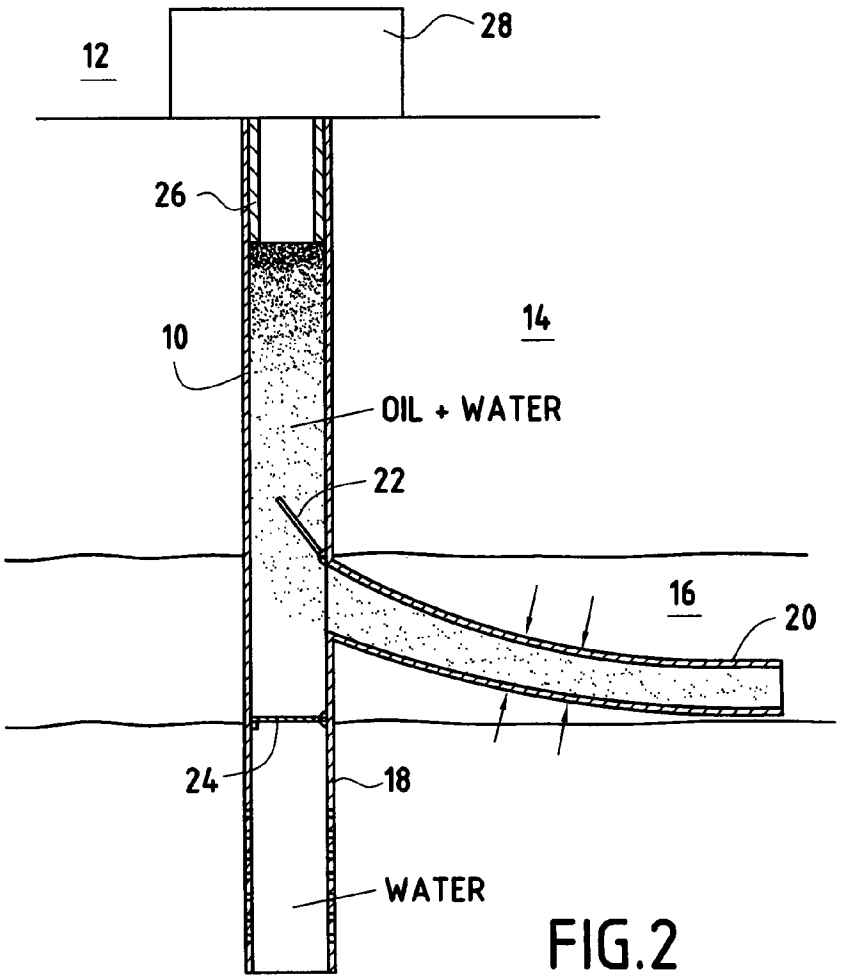
FIG. 2 shows the well of FIG. 1 in a first phase of operation.

FIG. 2 shows a first phase of operation of the well. In this phase, the valve from the lateral branch 20 is open and the valve 24 into the lower section closed. Formation fluids are produced into the lateral branch 20 (the first zone) in the normal manner. The fluids comprise a mixture of oil and water and will flow into the well until the hydrostatic head of the column of fluids in the vertical section (the second zone) 10 balances the pressure of the fluids in the formation 16. At this point the production is naturally killed but the upper surface of the fluids in the well is still too far below the surface to be pumped from the surface.

Figure 4:
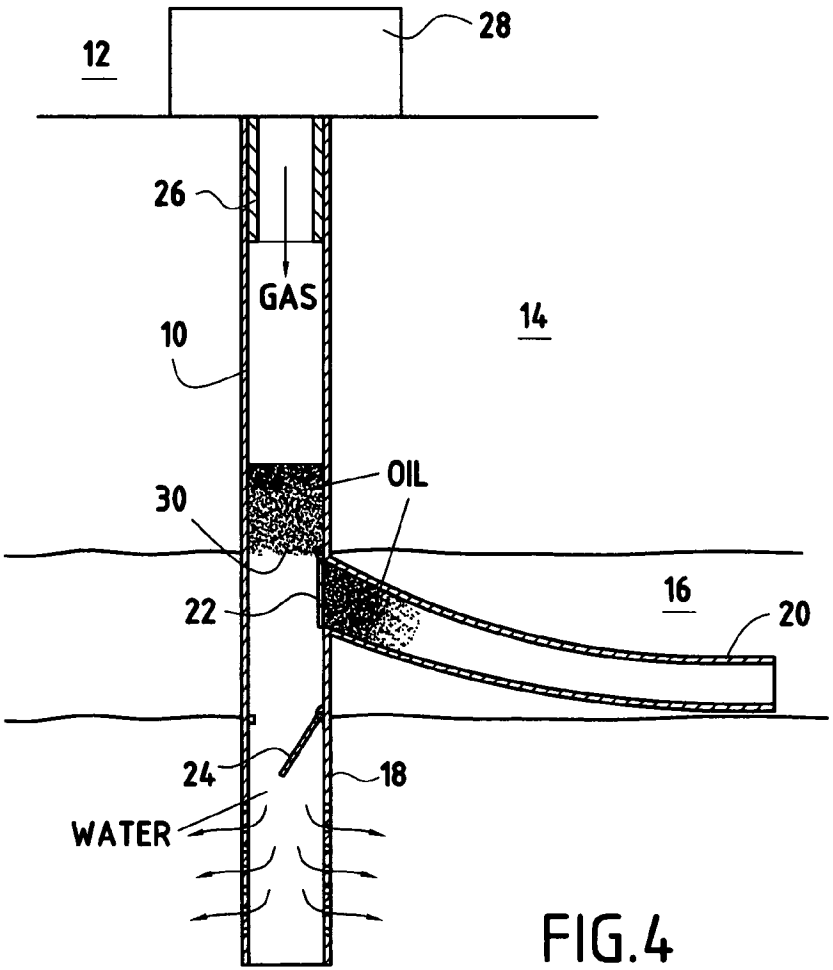
FIG. 4 shows the well of FIG. 1 in a third phase of operation.
Figure 3:
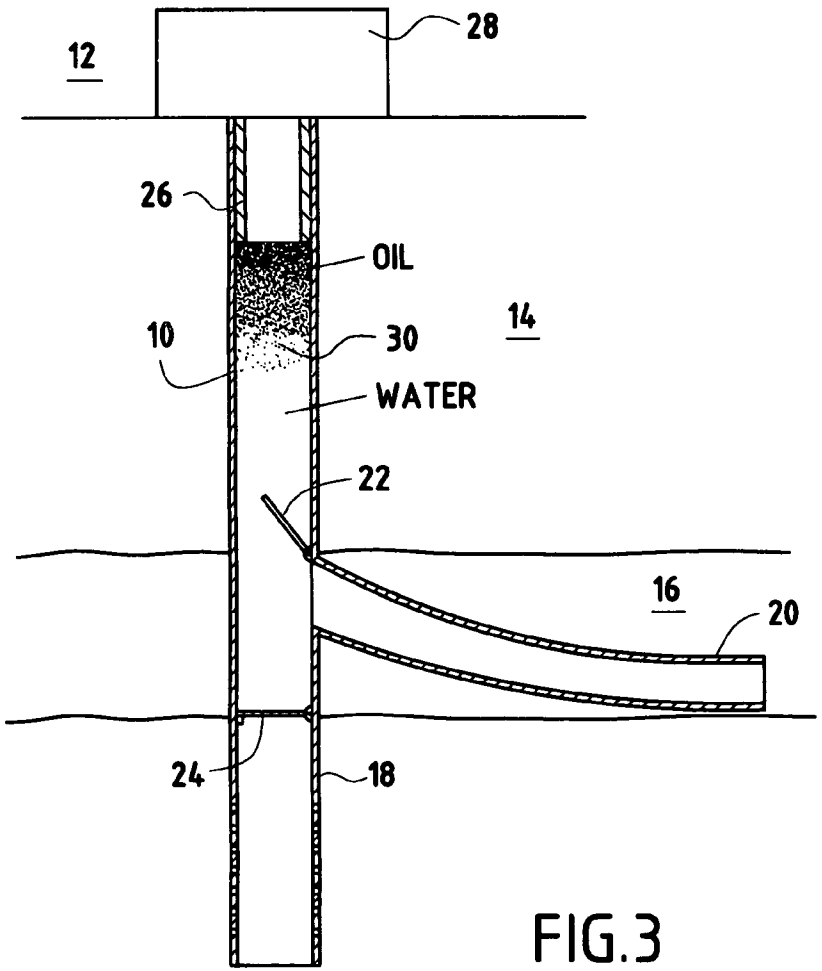
FIG. 3 shows the well of FIG. 1 in a second phase of operation.

The second phase of operation is shown in FIG. 3. In this phase, the fluids in the well are allowed to separate under the effect of gravity, the oil rising to the top as it is less dense than the water. The time for substantially all of the oil to separate from the water will depend on a number of factors that are discussed in more detail below. Once it is determined that separation is effectively complete, operation progresses to the third phase as shown in FIG. 4.

In the third phase, pressure is applied to the top of the fluid column, for example by the use of pressurised nitrogen gas. At the same time, the valve 22 into the lateral branch 20 is closed and the valve 24 into the lower section of the well (the third zone) 18 opened. The pressure of the gas forces the fluids back down the well and the water is re-injected into the formation below the producing interval 16. Since the valve 22 is closed, no water will enter the lateral branch 20 although some separation will take place due to the inclination to horizontal of the branch resulting in a sump of water at the distal end of the branch. Injection is continued until the oil water interface 30 reaches the level of the valve 24 at the latest. At this point, re-injection is stopped.

Figure 5:
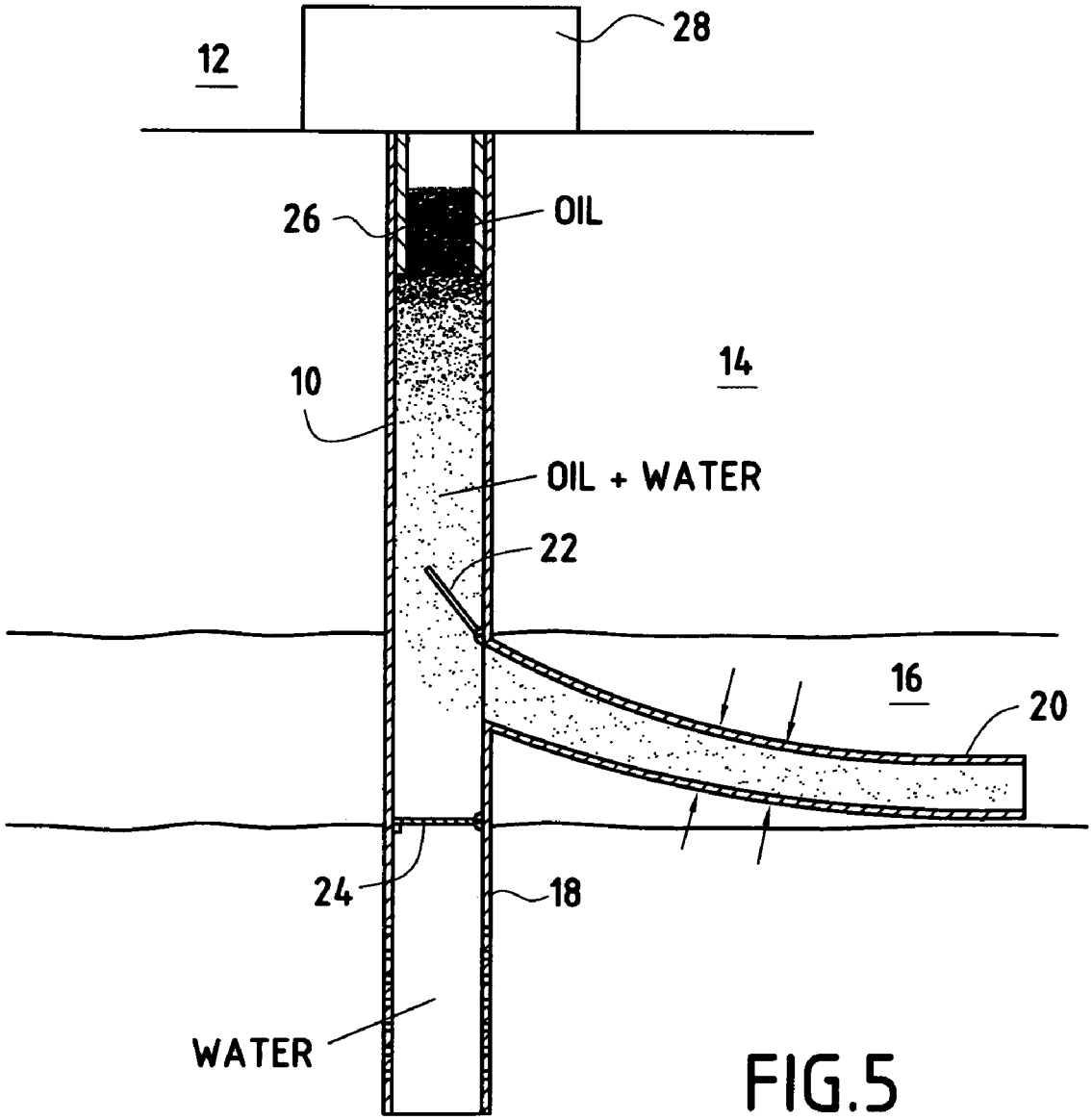
FIG. 5 shows the well of FIG. 1 in a fourth phase of operation.

In the fourth phase of operation, as shown in FIG. 5, the pressure on the top of the fluid column is released and the branch 20 allowed to recommence production. At this stage, the valve 22 is open to allow produced fluids (oil and water) into the upper vertical section of the well. Production of fluids will recommence because the height of the fluid column in the vertical section is less than when the well killed itself and so the hydrostatic pressure will be lower than the formation pressure. However, in this case, the fluid in the vertical section of the well is less dense than before since it comprises (mainly) oil rather than a mixture of oil and water. Therefore, the resulting column will rise further up the well before the hydrostatic pressure again kills production.

By repeating the phases of separation, re-injection and production, the density of the fluid column in the vertical section of the well is progressively reduced until the top of the column reaches the top of the well, or is sufficiently close to allow production to the surface to take place. Production of oil from the well will continue until the amount of water in the vertical section of the well increases to a level at which the hydrostatic head again kills the well, following which the cycle of separation, re-injection and production is repeated.

This method of operation has a number of advantages over previously proposed methods of assisted production from wells. First, all of the powered equipment is located at the surface, making power supply and maintenance easier and cheaper. Second, the water content of the fluids produced from the well is reduced, thus necessitating the use of simpler and cheaper separation equipment. Third, the re-injection of the separated water into the formation below the producing interval helps to maintain reservoir pressure and avoid many of the problems of disposal of produced water. These and other advantages make the method of the invention particularly applicable to wells in reservoirs with weak or falling pressures that would otherwise require the use of expensive downhole pumps in order to extract oil therefrom. While the above example has been described using a single lateral branch, it is also possible to use multiple lateral branches, in the same or different producing intervals. The can be formed when the well is originally drilled, or later in the well's life by returning with drilling equipment for use in an existing well.

The following example is given to demonstrate the manner in which the invention can be used. For a well as shown in FIG. 1, the following parameters are given:

| Well Geometry | |
|---|---|
| Vertical Section (10) ID | 15 cm |
| Tubing (26) ID | 7.5 cm |
| Depth to bottom of Tubing (26) | 1800 m |
| Depth to Horizontal Branch (20) | 2000 m |
| Depth of Vertical Section (18) below Branch | 30 m |
| Horizontal Length of Branch (20) | 300 m |
| Thickness of Producing Interval (16) | 6.5 m |

| Reservoir Properties | |
|---|---|
| Max Water Cut* | 80% |
| Max Drawdown in Horizontal Branch (20)** | 100 psi |
| Fracture Pressure in Lower Vertical Section (18)** | 3100 psi |
| Reservoir Pressure* | 2700 psi |
| Horizontal Permeability* | 300 mD |

-continued

| Reservoir Properties | |
|---|---|
| Vertical Permeability* | 100 mD |
| Porosity* | 0.2 |
| Oil Viscosity* | 0.001 Pa.s |
| Water Viscosity* | 0.0005 Pa.s |
| Oil Density* | 0.8 g/cc |
| Water Density* | 1 g/cc |

*Property obtained from open-hole or cased-hole logging measurements, fluid sampling, etc.
**Calculated from known relationships, e.g. Kuchuck F.J. & Goode P.A. "Pressure Transient Analysis & Inflow Performance for Horizontal Wells" 1988 SPE Technical Conference, or Fundamentals of Reservoir Engineering (L.P. Dave) Elsevier 1978 (Oilwell Testing, p. 159).

In order to observe the maximum drawdown, the production rate (as found in the first and fourth phases described above) is established at 1212 $m^3$/day. The maximum drawdown will typically be established to avoid collapsing the formation and to stay below the bubble point for the oil. The injection rate for the third phase is set at 2461.916 $m^3$/day in order not to exceed the fracture pressure of the formation. In certain circumstances, it may be desirable to exceed this pressure and fracture the formation in order to improve the injection of water into the formation.

The duration of separation in the second phase is calculated using Stoke's law and is determined as the time taken for an oil bubble to travel the average distance during separation. This distance is assumed to be the distance from the half height of the water column (when fully separated) to the half height of the oil column (when fully separated). The heights of the fluid columns can be calculated knowing the water cut and well geometry. The time taken for a bubble to travel the average distance depends on the relative densities and viscosities of the oil and water and the size of the bubble. The former are obtained from direct measurement or from standard data, the latter is obtained by direct measurement of bubble size using production logging tools, or from flow loop data relating bubble size to water cut.

Applying these parameters to the well geometry given above gives the following durations:

| | |
|---|---|
| Production Duration ($1^{st}$ & $4^{th}$ Phases) | 839 s |
| Separation Duration ($2^{nd}$ Phase) | 2454 s |
| Re-injection Duration ($3^{rd}$ Phase) | 413 s |
| Cycle Duration | 3706 s |

The daily oil production in this case is 55 $m^3$.

The geometry and operating parameters can be varied to suit specific well requirements.

The invention claimed is:

1. A method of producing oil from a well comprising:

a vertical section extending from the surface to a depth below the oil-producing formation;

a sidetrack extending from the vertical section into the oil-producing formation; and a first valve, located in the well at a level within the oil-producing formation, and operable to prevent flow of fluid from the vertical section into the sidetrack;

a second valve, located in the well at a level below the oil-producing formation, and operable to prevent flow fluid from the portion of the vertical section below the oil-production formation into the sidetrack or the portion of the vertical section of the well above the sidetrack;

said method comprising the step of:

allowing oil and water to flow into the well via the sidetrack until the hydrostatic pressure of the oil and water in the well balances the formation pressure of the oil-producing formation such that further flow into the well ceases;

allowing the oil and water in the vertical section of the well to separate under gravity so as to produce (i) a lower layer of water, at least part of which is located in the part of the vertical section below the oil-producing formation, and (ii) an upper layer of oil having its upper surface below the well surface and its lower surface above the sidetrack;

forcing the separated oil and water back down the well and operating the first valve such that substantially no fluid is forced into the sidetrack, and water is forced into the underground formation below the oil-producing formation; and allowing oil and water flow to recommence from the sidetrack.

2. The method of claim 1, wherein separated oil and water are forced down the well until the oil water interface is close to the lower end of the vertical section.

3. The method of claim 1, wherein the steps of flowing, separating, forcing back are repeated until oil flows from the well at the surface.

4. The method of claim 1, wherein the step of forcing separated oil and water down the well is performed by applying pressure to the vertical section from the surface.

5. The method of claim 4, wherein pressure is applied by pumping oil or gas into the vertical section.

6. The method of claim 1, wherein the separated oil and water are forced back down the well such that the water is re-injected into the underground formation below the producing formation.

7. The method of claim 6, wherein the re-injection is performed below the fracture pressure of the underground formation.

8. The method of claim 1, wherein the oil is pumped from the well.

* * * * *